US006305102B1

(12) United States Patent
Doyle

(10) Patent No.: US 6,305,102 B1
(45) Date of Patent: Oct. 23, 2001

(54) PNEUMATIC INFLATING DEVICE

(76) Inventor: Harold S. Doyle, 7762 Ramsgate Cir. South, Hanover Park, IL (US) 60103

( * ) Notice: Subject to any disclaimer, the term of this patent is extended or adjusted under 35 U.S.C. 154(b) by 0 days.

(21) Appl. No.: 09/424,938

(22) PCT Filed: Jun. 3, 1998

(86) PCT No.: PCT/US98/11307

§ 371 Date: Dec. 3, 1999

§ 102(e) Date: Dec. 3, 1999

(87) PCT Pub. No.: WO98/54996

PCT Pub. Date: Dec. 10, 1998

Related U.S. Application Data

(60) Provisional application No. 60/048,689, filed on Jun. 3, 1997.

(51) Int. Cl.[7] ..... A43B 7/14; A43B 13/20

(52) U.S. Cl. ..... 36/29; 36/93; 36/3 B; 36/71

(58) Field of Search ..... 36/28, 29, 3 R, 36/3 B, 35 B, 43, 44, 71, 88, 93; 417/480; 441/91

(56) References Cited

U.S. PATENT DOCUMENTS

| | | | | |
|---|---|---|---|---|
| 4,446,634 | * | 5/1984 | Johnson et al. | 36/29 |
| 5,092,060 | * | 3/1992 | Frachey et al. | 36/29 |
| 5,113,599 | * | 5/1992 | Cohen et al. | 36/88 |
| 5,987,779 | * | 11/1999 | Litchfield et al. | 36/29 |
| 6,014,823 | * | 1/2000 | Lakic | 36/93 |

FOREIGN PATENT DOCUMENTS

| | | | | |
|---|---|---|---|---|
| 93/14659 | * | 8/1993 | (WO) | 36/29 |
| 94/00032 | * | 1/1994 | (WO) | 36/88 |

* cited by examiner

*Primary Examiner*—M. D. Patterson

(57) ABSTRACT

A bellows pneumatic system including a pneumatic inflating device (12) disposed within the sole of a shoe (100) which is comprised of a plurality of bladders or bladder sets within the sole of the shoe, each bladder being connected to a flow switching device (18) via conduits.

6 Claims, 3 Drawing Sheets

PNEUMATIC INFLATING DEVICE

Applicant is the owner of U.S. Pat. No. 5,222,312, granted on Jun. 29, 1993, entitled Shoe With Pneumatic Inflating Device. The Applicant claims priority based on U.S. Provisional Patent Application Ser. No. 60/048,689, filed Jun. 3, 1997.

BACKGROUND OF THE INVENTION

This invention relates to a shoe having an inflation device disposed within the sole of the shoe which provides greater comfort, protection, and vertical bounce to the wearer. Previous shoe arrangements have included soles that can be inflated at the arch to provide support thereof. Other shoes contain soles which have sealed inflated chambers disposed within the soles in order to increase vertical bounce. These previous chambers are soft sided bladders which distort into a more convex or spherical shape upon inflation. If the walls of the bladder are not constrained, for instance by the structure of the sole of the shoe, the distortion occurs in every direction. Others have addressed this problem by placing a foam core inside the bladder and adhering the entire surface of the interior bladder walls to the entire exterior surface of the foam core as taught is U.S. Pat. No. 5,235,715 to Donzis. This arrangement of adhering all of the surface of the foam core limits the shape of the bladder to the shape of the foam core and does not allow for differential distortions of the bladder as the bladder is inflated. These previous shoes also have not allowed for selective adjustment of the pressure in the chambers and may therefore result in uneven air distribution in the sole of the shoe. This invention addresses the shortcomings of the previous bladder and shoe designs and provides differential distortion of the bladder as well as selective adjustment of the bladder inflation resulting in the wearer's ability to customize the performance of the shoe.

DISCLOSURE OF THE INVENTION

The present invention provides for an inflation device contained within the sole of the shoe which controls and distributes air pressure in several air bladders positioned throughout the sole of the shoe to provide increased comfort, protection, and vertical bounce. The invention allows each air bladder to be selectively pressurized to a desired pressure, thereby allowing the wearer to customize the performance of the shoe to the wearer's needs. The preferred embodiment of this invention includes a plurality of air bladders and/or bladder sets located at various points along the entire length of the sole, a pump either attached to the shoe, incorporated into the sole, or removable from the shoe which provides inflation of the individual bladders or bladder sets, a distribution manifold, a flow switching device, a release mechanism for each bladder or bladder set, and unidirectional flow mechanism for each bladder or bladder set. Each bladder may be a plastic envelope well known in the industry, or contain a foam core adhered to one or more internal surfaces of the bladder, as in the case of the preferred embodiment where the top surface of the foam core is adhered to the interior surface of the top side of the bladder. As the bladder is inflated, the side walls and lower surface of the bladder will tend to curve outward to a greater degree than the upper surface of the bladder which is constrained by the secured foam core. This arrangement provides a flat surface below the wearer's foot while allowing the sides and bottom of the bladder to push on the sole of the shoe to prevent the bladder from moving in the shoe.

BEST MODE FOR CARRYING OUT THE INVENTION

Figure 1:
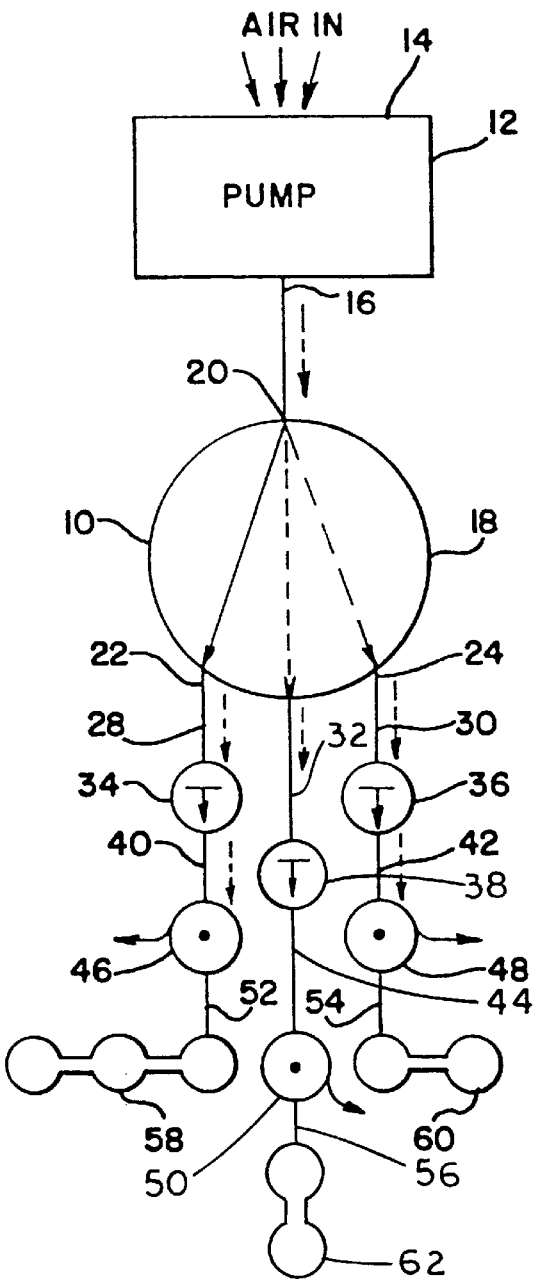
FIG. 1 is a general schematic of the inflating arrangement utilized in the shoe.

The present invention is directed to a shoe with a pneumatic inflating device disposed therein. The general schematic of the preferred embodiment of the shoe inflating arrangement is shown in FIG. 1 and includes three bladder sets. However, it will be apparent that the arrangement is adaptable to any plurality of bladder sets. The arrangement includes a pump 12 with an inlet 14 and an outlet 16. Outlet 16 is connected to a flow switching device 18 at a flow switching input 20. Flow switching device 18 operates as a selective valve which allows air flow into at least two outlets, the preferred embodiment having a first outlet 22, a second outlet 24, and a third outlet 26. Each outlet 22, 24, and 26 is connected to a corresponding conduit 28, 30, and 32. Each conduit 28, 30, and 32 is associated with corresponding unidirectional flow valves 34, 36, and 38. Each unidirectional flow valve 34, 36, and 38 is connected to corresponding conduit 40, 42, and 44. Each conduit 40, 42, and 44 is further associated with corresponding pressure release valves 46, 48, and 50. Conduits 52, 54, and 56 are connected to release valves 46, 48, and 50 and each conduit is connected to corresponding bladder sets 58, 60, and 62.

Figure 2:
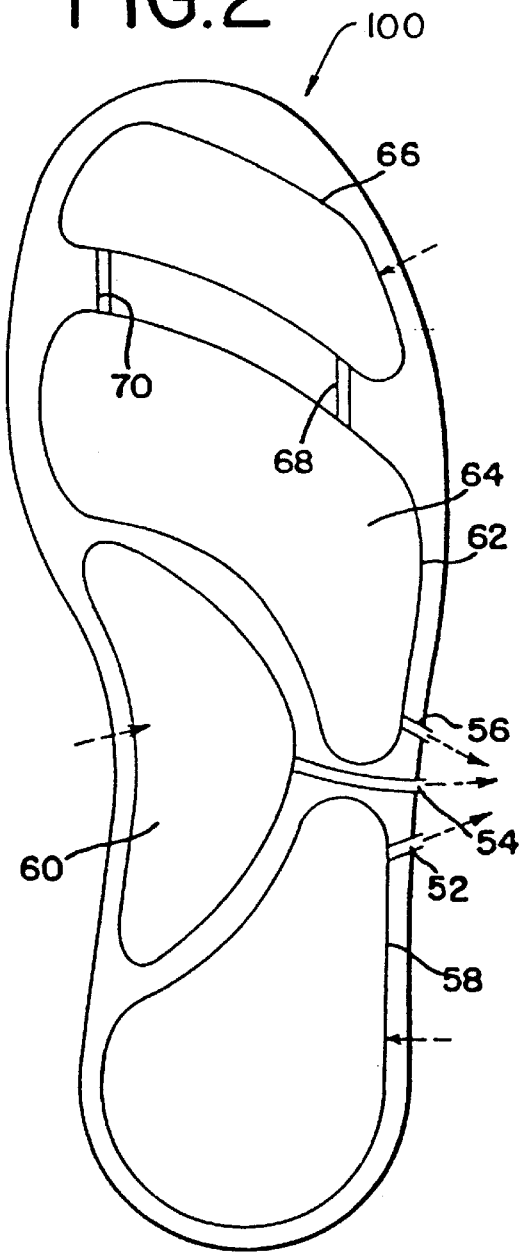
FIG. 2 is a horizontal cross section of the shoe sole, revealing the inflation bladders and conduits.

FIG. 2 shows one arrangement of separate bladder sets 58, 60, and 62 in the sole of shoe 100 in which forefoot bladder 62 is comprised of mid-forefoot bladder 64 and toe forefoot bladder 66. Bladders 64 and 66 are interconnected by conduits 68 and 70. This multiple bladder configuration may also be implemented on the other bladder sets.

To pressurize the pneumatic system, the wearer preferably engages outlet 16 of pump 12 with switching input 20. Pump 12 is mounted on a base portion 74 in which inlet 14 comprises an orifice 76 having a unidirectional inlet valve 78. As the bellows 82 is lifted, the change in volume of air chamber 80 causes a corresponding reduction in pressure, thus causing air to flow through orifice 76 and valve 78 into chamber 80. Bellows 82 is operatively connected with cover 84 pivotally connected at hinge portion 86. Cover 84 is latchable to lock 88 through means of flange 90 engaging lock 88. Cover 84 is releasable through use of a semi-rigid material in its construction which will enable flexing and thereby cause disengagement of flange 90 from latch 88. The wearer then compresses bellows 82 which allows air flow into switching input 20. This in turn allows air to fill the selected bladder set via flow switching device 18 in which the wearer can selectively control the air input to bladder sets 58, 60 and 62. The wearer may also adjust the pressure in each bladder set via the respective pressure release valve.

Figure 3:
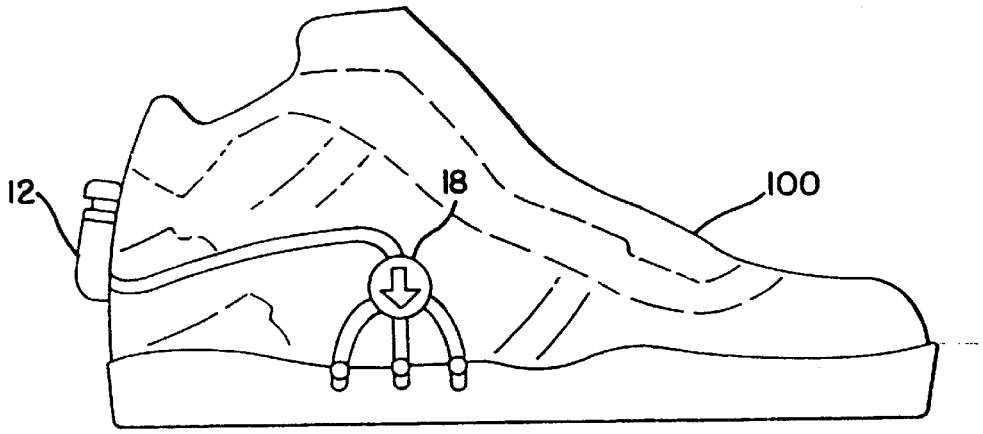
FIG. 3 is a side view of the shoe showing transparent conduits and the flow switching device.
Figure 4:
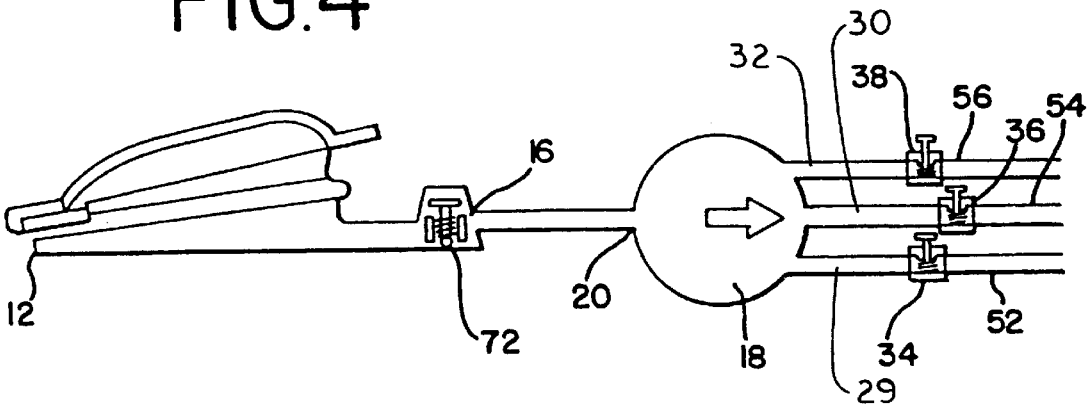
FIG. 4 shows a side bellows air pressurization unit coupled with an air release valve and a flow switching device.
Figure 5:
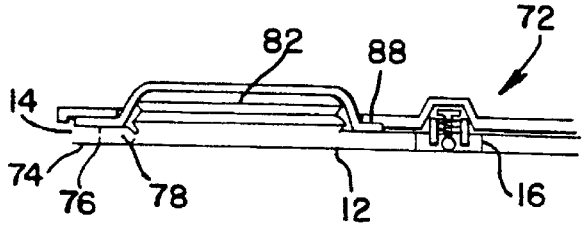
FIG. 5 shows the air pressurization unit in the closed position.
Figure 6:
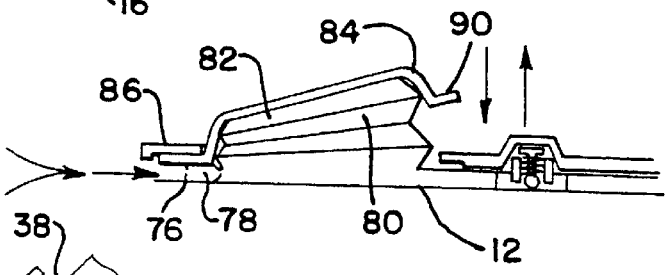
FIG. 6 shows the air pressurization unit in the open position.

The invention can be adapted to utilize a number of different combinations of elements to effectuate the goals of the invention. Thus, in FIG. 3, pump 12 could utilize an integral heel mounted plunger-type pump, as taught in my U.S. Pat. No. 5,222,312, which is incorporated by reference herein. The plunger type pump could also be disposed in the sole of the shoe, or for that matter, located at any convenient place on the shoe. As an alternative to the plunger-type pump 12, the bellows-type pump of FIGS. 4, 5 and 6 could also be used.

Another variation is in the use, in the alternative, of different arrangements for flow switching device 18. A first embodiment could utilize a simple "lie" type flow switching device in which pressure at input 20 is applied equally at each of conduits 52, 54, and 56 applying equilibrium pressure at 20 using pump 12 and valves 34, 36, and 38 would result in equal pressurization of each bladder arrangement 58, 60, and 62. Customization of pressures could be accomplished by the simple expedient of bleeding off high pressure to reduce pressure in one or more of the selected bladder arrangements 58, 60, and 62. Well known valves of the Schrader type could be utilized with push button release or variations such as the Presta type which is effectively lockable for the tightening of a threaded collar on the valve needle.

Figure 7:
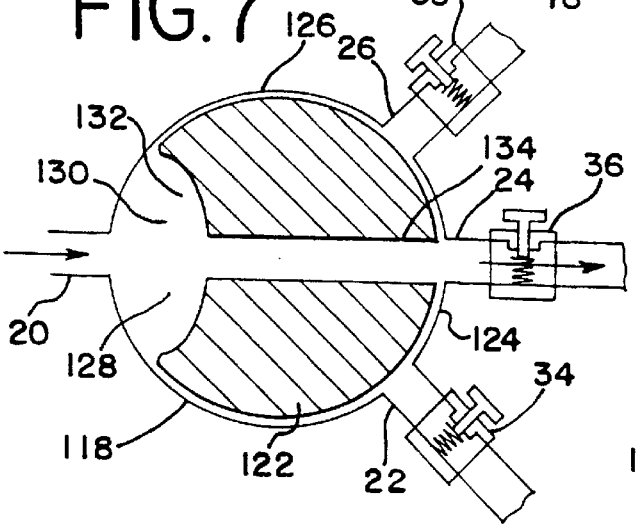
FIG. 7 is a sectional view of a switching input device.
Figure 8:
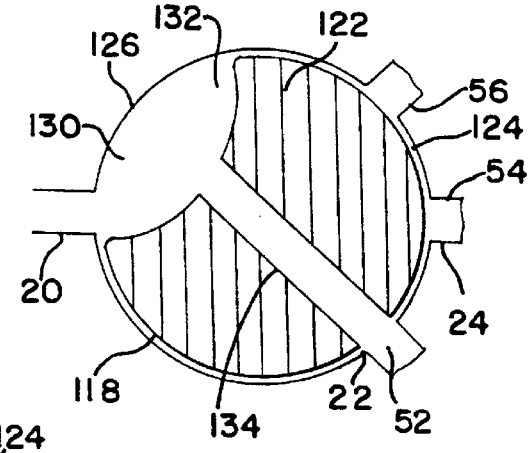
FIG. 8 is a sectional view of the switching input device in a second position.
Figure 9:
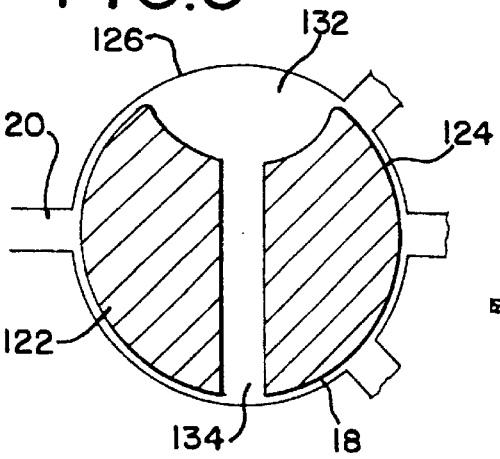
FIG. 9 is a sectional view of the switching device in a closed position.

A second alternative is to use a specially designed flow switching device having both flow directional control and valving control. Thus, switching device 118 in FIGS. 7, 8, and 9 uses rotor 122 contained within circumferential wall 124 of body 126 of device 118. Body 126 also has a floor 128 and atop (not shown)to completely define an enclosed plenum 130. Rotor 122 is sealed against wall 126 in such manner that rotor 122 may be turned in a plurality of positions. In FIG. 7, inlet chamber 132 is aligned with inlet 20 and in communication with passageway 134 that, in FIG. 7, further communicates to outlet 24. By comparison, in FIG. 8, rotor 122 has been turned so that conduit 134 is now in communication with outlet 22 while chamber 132 owing to its elongated configuration. In FIG. 9, rotor 122 has been further turned so that both chamber 132 and conduit 134 abut wall 126, thereby restricting passage of air between inlet 20 and any of outlets 22, 24, or 26. In like manner, of course, the rotor could be aligned with outlet 26 and inlet 20. It is also possible to adapt flow switching device 118 to a greater or lesser number of outlets, as desired. In the preferred embodiment, outlets 22, 24, and 26 would be associated with valves 34, 36, and 38, respectively. As described above, these could be of the Schrader or other improved Schrader types. Use of this approach in addition to the positional adjustment of rotor 122 to the closed position as shown in FIG. 9 would minimize pressure loss from bladders 58, 60, and 62.

Nevertheless, with the use of suitable sealing materials, and an integral pump, the user could dispense with all valves save the flow switching device 118. Use of a resilient, air impervious rotor 122 could provide self-sealing while appropriate coatings or seals, in the nature of gaskets or O-rings, could also be utilized.

An additional variation would be to use a separable pump. This would save the user the bulk of having an attached pump, further enabling the use of a larger capacity pump obviating bulk or weight concerns and enabling the use of higher strength or more economical materials than would be desirable with an integral, attached pump. Use of a separable pump would be more likely to take advantage of the use of a valve 72 associated with inlet 20, in the manner shown in FIG. 5.

Figure 10:
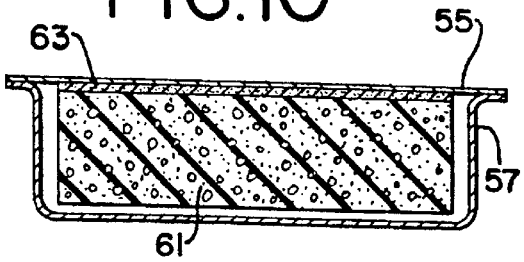
FIG. 10 is a sectional view of a bladder with a foam core.

The bladders 58, 60 and 62 can be any plastic envelope. The bladder membranes forming the envelope are resistant to the passage of gas molecules but need not be totally impermeable. The gas within the bladder should not escape so rapidly that re-inflation of the bladder will be needed more often than every thirty minutes of use. The bladder may also contain a foam core 61 where the foam may be any foam such as ethyl vinyl acetate (EVA), polyurethane (PU), a composite using these materials, or any other resilient sponge material known or that may become known in the footwear industry. One face of the foam core is secured to one interior wall or surface of the bladder. In the preferred embodiment shown in cross section in FIG. 10, the top surface of the foam core 61 is secured by an adhesive 63 to the interior surface of the top membrane 55 of the inflatable bladder 57. The adhesive 63 may be contact cement, heat activated cement, or solvent based cement. Alternatively, the bladder membrane may be attached to the foam core 61 by heat or radio welding.

Alternative embodiments are the attachment of the bladder membrane to the sides of the foam core or attachment of the lower membrane in the lower surface of the foam element.

Various features of the invention have been particularly shown and described in connection with the illustrated embodiments of the invention, however, it must be understood that these particular arrangements merely illustrate, and that the invention is to be given its fullest interpretation within the terms of the appended claims.

What is claimed:

1. A pneumatic inflating device disposed within the sole of a shoe, said pneumatic inflating device comprising:

first and second bladders;

first and second conduits, each conduit having a first end connected, respectively, to the first and second bladders, each of the first and second conduits further having a second end connected to a flow switching device;

first and second unidirectional flow valves disposed, respectively, within the first and second conduits and between the flow switching device and the first and second bladders, respectively; and first and second pressure release valves connected, respectively, to the first and second conduits between, respectively, the first unidirectional flow valve and the and the first bladder and between the second unidirectional flow valve and the second bladder.

2. The pneumatic inflating device of claim 1 further including:

a third bladder connected to the flow switching device by a third conduit;

a third unidirectional flow valve between the flow switching device and the third bladder; and a third pressure release valve between the third unidirectional flow valve and the third bladder.

3. The pneumatic inflating device of claim 1 further comprising a bellows pump connected to the flow switching device.

4. The pneumatic inflating device of claim 2 wherein the bellows pump is attached to the shoe.

5. The bellows pneumatic inflating device of claim 1 wherein the first bladder includes:

a bladder membrane having an interior and an exterior side;

a foam core contained within the bladder, said foam core having a plurality of sides;

an adhesive disposed on only one side of the foam core; and a portion of the interior side of the bladder membrane adheres to the adhesive.

6. A bellows pneumatic inflating device disposed within the sole of a shoe, said bellows pneumatic inflating device comprising:

a plurality of bladders disposed within the sole of said shoe;

a plurality of conduits having a first end connected to said bladders and a second end;

a plurality of unidirectional flow valves, one disposed within each of said conduits;

a plurality of pressure release valves, one connected to each conduit between the unidirectional flow valve and the second end;

an output switching device having an input and a plurality of outputs, each output connected to the second end of a conduit;

a bellows pump attached to the shoe and having an output connected to the input of the switching device; and wherein the bellows pump includes a base and a cover;

said base being hinged to said cover;

said cover having a flange;

said base having a latch to engage said flange.

* * * * *

UNITED STATES PATENT AND TRADEMARK OFFICE

CERTIFICATE OF CORRECTION

PATENT NO. : 6,305,102 B1
DATED : October 23, 2001
INVENTOR(S) : Harold S. Doyle It is certified that error appears in the above-identified patent and that said Letters Patent is hereby corrected as shown below:

Column 3,
Line 37, delete "atop" and insert -- a top --.

Signed and Sealed this

Nineteenth Day of March, 2002

*Attest:*

*Attesting Officer*

JAMES E. ROGAN
*Director of the United States Patent and Trademark Office*